United States Patent [19]

Newman

[11] 4,398,918

[45] Aug. 16, 1983

[54] USE OF ETHOXYLATED DIALKYL QUATERNARY AMMONIUM DERIVATIVES AS SUSPENDING AGENTS FOR COAL-OIL MIXTURES

[75] Inventor: Thomas C. Newman, Hinsdale, Ill.

[73] Assignee: Akzona Incorporated, Asheville, N.C.

[21] Appl. No.: 338,781

[22] Filed: Jan. 11, 1982

[51] Int. Cl.[3] ..... C10L 1/32

[52] U.S. Cl. ..... 44/51; 44/72; 44/79

[58] Field of Search ..... 44/51, 72, 79

[56] References Cited

U.S. PATENT DOCUMENTS 4,201,552 5/1981 Rowell et al. ..... 44/51

FOREIGN PATENT DOCUMENTS 53-123407 10/1978 Japan ..... 44/51

54-126205 10/1979 Japan .

OTHER PUBLICATIONS

*McCutcheon's Detergents & Emulsifiers,* 1973 North American Edition, Allured Publishing Corp., Ridgewood, New Jersey, pp. 52, 103–104.

*Primary Examiner*—Charles F. Warren

*Assistant Examiner*—Margaret B. Medley

*Attorney, Agent, or Firm*—Francis W. Young; Daniel N. Christus

[57] ABSTRACT

Comminuted coal-oil mixtures are provided which may be maintained in a homogeneous state by the addition of a polyethoxylated, straight chain aliphatic quaternary ammonium compound corresponding to the formula:

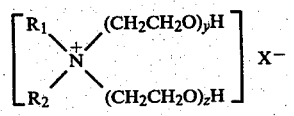

wherein $R_1$ and $R_2$ are each aliphatic groups having from 8 to 22 carbon atoms, wherein y and z are integers having a value of 1 or greater, the sum of y and z being between 2 and 15, and wherein X is an anion selected from the group consisting of $CH_3COO^-$, $Cl^-$, $BO_3^-$, and $(CH_3)_2SO_4^-$.

11 Claims, No Drawings

USE OF ETHOXYLATED DIALKYL QUATERNARY AMMONIUM DERIVATIVES AS SUSPENDING AGENTS FOR COAL-OIL MIXTURES

BACKGROUND OF THE INVENTION

The present invention relates in general to combustible fuel slurries containing liquid hydrocarbon fuel and comminuted coal in the liquid hydrocarbon. More particularly, it relates to the prevention or substantial reduction of the settling of the comminuted coal particles in the liquid hydrocarbon.

The United States possesses the largest proven mineral coal deposits in the world. The reserves are enormous and have a combined BTU value far exceeding that of the liquid reserves in the Middle East nations. Yet the United States continues to import a substantial portion of its energy requirements from abroad, and has not yet fully utilized its coal resources.

Efforts to increase coal utilization have included combining comminuted coal to fuel oil to form a slurry which may be fed to a furnace, boiler, or other oil burning device. The coal must be of a relatively small particle size; coal fines may be used in the mixtures to solve a long-standing disposal problem. Large particles will have a tendency to settle more rapidly and will further cause abrasion as they pass through the fuel feed nozzles and may even clog the nozzles.

The most pertinent prior art references include U.S. Pat. No. 4,201,552, issued to Rowell et al on May 6, 1980, hereinafter referred to as Rowell. Rowell discloses that quaternary ammonium compounds having a morpholinium or other cyclic structure are useful as stabilizers for coal-oil slurries, but does not disclose any non-cyclic quaternary stabilizers. Japanese application No. 32886/78, by Nakamura et al, was published on Oct. 1, 1979, and is also directed to cyclic ethoxylated quaternary ammonium salts said to be useful as coal oil mixture stabilizers. Examples of suitable stabilizers disclosed thereon include imidazoline and diimidazoline compounds, the latter typically having substituted benzenesulfonate as the anion.

SUMMARY OF THE INVENTION

The invention is a fuel slurry composition comprising 10 to 60 weight percent coal particles, at least 80 percent of which are smaller than 200 mesh, 39 to 89 percent hydrocarbon fuel, 0.5 to 3.0 weight percent water, and 0.1 to 1.0 weight percent of a stabilizer corresponding to the general formula: .

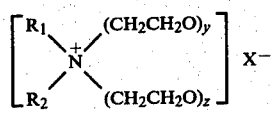

wherein $R_1$ and $R_2$ are each straight or branched-chain aliphatic groups having from 8 to 22 carbon atoms, y and z are integers having a value of 1 or greater, the sum of y and z being between 2 and 15, and wherein X is an anion selected from the group consisting of $CH_3COO^-$, $Cl^-$, $BO_3^-$, and $(CH_3)_2SO_4^-$, the slurry remaining in a substantially homogeneous state when left standing without agitation for at least twenty-four hours.

A further aspect of the invention is a stabilizer having between 8 and 15 moles of ethoxylation per mole of stabilizer, and wherein the ethoxy groups may be distributed non-uniformly on the ethoxylated sites of the quaternary ammonium compound's nitrogen. A still further aspect of the invention may comprise a stabilizer wherein each of the R groups are straight chain aliphatic groups of between 12 and 18 carbon atoms. A yet further aspect of the invention may comprise a stabilizer including the borate ion.

The present invention is suitable for maintaining a fuel slurry composition in a substantially homogeneous state for at least twenty-four hours without the need for agitation. It permits the simultaneous use of plentiful coal with relatively scarce fuel oil in oil-fired combustion devices so as to conserve the oil. Another object of the invention is to provide a novel stabilizer for use in preparing fuel slurry compositions.

DESCRIPTION OF THE PREFERRED EMBODIMENTS

The present invention is directed to a fuel slurry composition comprising 10 to 60 weight percent coal particles, at least 80% of which are smaller than 200 mesh. Pittsburgh seam coal is typical of those suitable for the present invention, but it is anticipated by the inventors that the stabilizer used herein will be effective in fuel slurry compositions including all bituminous and anthracite coals, coke, petroleum coke, lignite, charcoal, peat, and combinations of the above. The term liquid hydrocarbon fuel as used herein shall include crude and refined hydrocarbon based oils, such as petroleum fuel oils and heavy residual oils. Most preferred is a slurry comprising a No. 6 residual fuel oil, as is typically used in boilers.

Water may be added to the slurry at between 0.5 and 3.0 percent by weight, or it may inhere in the coal added to the composition. Water may improve the stability of the resulting slurry, but the amounts used should be limited because the water lowers the heat value and increases transportation costs of the composition.

The stabilizers which may be employed in the present invention include polyethoxylated quaternary ammonium salts, as for example the ETHOQUAD® polyethoxylated quaternary ammonium salts manufactured by the Armak Company, 300 South Wacker Drive, Chicago, Ill. 60606. These compounds are formed by the addition of aryl chlorides to a polyethoxylated amine. Such salts are stable in both acid and alkaline solutions, and have good relative water solubility. They are of the general formula:

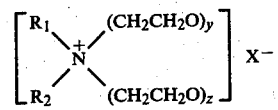

wherein $R_1$ and $R_2$ are each straight or branched-chain aliphatic groups having from 8 to 22 carbon atoms, y and z are positive intergers whose sum is 15 or less, and X is one of the anions $CH_3COO^-$, $Cl^-$, $BO_3^-$, or $(CH_3)_2SO_4^-$. An example of such a stabilizer is ETHOQUAD® 2C/15 Borate, a compound having the general formula above wherein $R_1$ and $R_2$ are each the coco group, the $C_{12}H_{25}^-$ saturated straight-chain and long-chain hydrocarbon group otherwise known as the n-dodecanyl radical. The sum of x and y is 5, but there are varying degrees of ethoxylation on each of the two ethoxy groups. For example, ETHOQUAD® 2C/15 Borate will be a mixture of molecules, including $$[(C_{12}H_{25})_2N—(CH_2CH_2O)_3(CH_2CH_2O)_2]BO_3^-, \text{ or}$$

$$[(C_{12}H_{25})_2N—(CH_2CH_2O)_1(CH_2CH_2O)_4]BO_3^-.$$

and others. The extent of ethoxylation is constant, with 5 ethoxy moles per mole of stabilizer, but the site of the ethoxy groups upon the quaternary ammonium nitrogen varies.

Another example of a suitable stabilizer is ETHOQUAD® 2T/15 Borate, identical to ETHOQUAD® 2C/15 Borate except for the R groups. In the 2T compounds, the R groups comprise the tallow radical, otherwise known as the unsaturated, straight- and long-chain $C_{18}H_{35}$- radical.

Typically, the coal-oil mixture is prepared in the laboratory by blending a specified surfactant with the liquid hydrocarbon fuel and heating the blend to 150° F. in an oven. The blend and its container are then placed in a hot water bath at 150° F. and stirred with a standard, impeller-type mixer at mid-range speed for five minutes. Then, deionized water is added and agitation continued for another five minutes. To this surfactant-oil-water mixture is slowly added fine mesh coal with continued agitation. After all the coal has been added, the blend is agitated at a high speed for fifteen minutes to ensure proper wetting of the coal sample. The order of mixing is not critical and several of the mixtures were prepared by blending ingredients in a different order, as will be demonstrated in the examples below.

Commercial preparation is similar. The fuel oil or other liquid hydrocarbon is added to any vessel with a means of agitation, and is preferably heated so that it is liquid enough to be stirred thoroughly. The surfactant is added, and then the water, if desired. Finally, the finely divided coal is added with slow agitation and the speed of the agitators increased when all the coal has been added to the batch mixture.

The types of oils which are most suitable for use in this invention include all those oils and blends which are currently used to fuel commercial and industrial boilers, including light and heavy fuel oils. Different types of coals may also be used, with the amount of surfactant required depending upon the type of coal used.

The following specific examples indicate preferred embodiments of the invention. These are given as illustrative only, and will suggest various changes and modifications within the intended scope of the invention to those skilled in the art.

EXAMPLE 1

Fuel oil from the Atlantic Richfield Company (ARCO fuel oil #6) is placed in a container and warmed to approximately 150° F. One hundred seventy-eight and one-half grams (178.5 grams) of this warmed oil is transfered to a one pint jar. To this oil is added one and one-half grams (1.5 grams) of 62% active ETHOQUAD® 2C/15 Borate stabilizer and 10.0 grams of deionized water. This oil-surfactant-water mixture is then stirred at moderate speed for approximately 5 minutes. Finally, 157.5 grams of a Pittsburgh Seam Coal, 80% of which passes through a 200 mesh U.S. Standard screen, is slowly added with continued agitation. After all the coal has been added, the blend is agitated at high speed for 15 minutes so as to ensure adequate wetting of the coal.

EXAMPLE 2

Fuel oil from the Atlantic Richfield Company (ARCO fuel oil #6) is placed in a container and warmed to approximately 150° F. One hundred seventy-eight and one-half grams (178.5 grams) of this warmed oil is transferred to a one pint jar. To this oil is added one and one-half grams (1.5 grams) of 83.2% active ETHOQUAD® 2T/15 Borate stabilizer and 10.0 grams of deionized water. This oil-surfactant-water mixture is then stirred at moderate speed for approximately 5 minutes. Finally, 157.5 grams of a Pittsburgh Seam Coal, 80% of which passes through a 200 mesh U.S. Standard screen, is slowly added with continued agitation. After all the coal has been added, the blend is agitated at high speed for 15 minutes so as to ensure adequate wetting of the coal.

EXAMPLE 3

Fuel oil from the Atlantic Richfield Company (ARCO fuel oil #6) is placed in a container and warmed to approximately 150° F. One hundred seventy eight and one-half grams (178.5 grams) of this warmed oil is transferred to a one pint jar. To this oil is added one and one half grams (1.5 grams) of 90% active ETHOQUAD® 2T/14 Acetate stabilizer and 10.0 grams of deionized water. This oil-surfactant-water mixture is then stirred at moderate speed for approximately 5 minutes. Finally, 157.5 grams of a Pittsburgh Seam Coal, 80% of which passes through a 200 mesh U.S. Standard screen, is slowly added with continued agitation. After all the coal has been added, the blend is agitated at high speed for 15 minutes so as to ensure adequate wetting of the coal.

The relative stability of the above three combustible fuel slurries and others were measured by generating a "Viscosity Profile" of each at 24, 48, and 72 hours. To generate the profiles, a Brookfield viscometer equipped with a "Helipath" attachment is utilized. The motor-driven viscometer descends at a constant vertical rate into the sample so as to allow the "T"-shaped spindle to continually shear fresh volumes of slurry. Instantaneous shear stress readings were taken during the entire descent of the spindle and may be plotted on graph paper or tabulated. If the slurry remains in a substantially homogeneous state during storage, then the viscosity will remain the same or increase slightly at various depths in a column of the solution. Conversely, the coal particles of an unstable slurry will precipitate out, causing a substantial increase in the viscosity as one moves towards the bottom of the column. Thus, a good suspending agent is one that maintains the coal-oil mixture in a substantially homogeneous form. Such an agent gives an indication of its efficacy by relatively uniform viscosity readings through the length of the column.

Various emulsifiers at an active concentration of 0.3% were tested in a coal-oil mixture of 45.52% 200 mesh Pittsburgh Seam Coal, 51.6% ARCO #6 oil and 2.89% $H_2O$, including the following. All except the first are products of the Armak Company, 300 South Wacker Drive, Chicago, Ill. 60606.

1. ES 7071, a product of BASF Wyandotte Corporation, Parsippany, N.J.
2. Ethomeen® C/12 polyethoxylated amine
3. Ethoduomeen® TD/13 polyethoxylated diamine
4. Ethoquad® T/12 polyethoxylated quaternary ammonium salt 5. Ethoduoquad ® T/15 Acetate ethoxylated diamine quaternary ammonium salt
6. Arquad ® LPS quaternary ammonium chloride
7. Duoquad ® T-50 quaternary ammonium chloride
8. Propoquad ® HT/12 polypropoxylated quaternary ammonium salt
9 Ethoquad ® 2C/15 Borate polyethoxylated quaternary ammonium salt
10. Ethoquad ® 2T/15 Acetate polyethoxylated quaternary ammonium salt
11. Ethoquad ® 2T/15 Borate polyethoxylated quaternary ammonium salt After thorough mixing, the mixtures were placed in a 150° F. oven and left to stand in the sealed column for 24 hours. The viscosities at the various depths were then determined with a Brookfield viscometer as described above and while the columns were immersed in a 150° F. water bath. The viscosity vs. depth is tabulated below for the above eleven emulsifiers. The difference ($\Delta\mu$15-1) between the viscosity at the deepest and the shallowest points where a reading was taken are indicated at the bottom of each of the columns in Table 1.

Viscosity vs. Depth for Coal-Oil Mixtures at 0.3% (active) Stabilizer after 24 hours

| | VISCOSITY | | | | | | | | | | |
|---|---|---|---|---|---|---|---|---|---|---|---|
| Depth Stabilizer | 1 | 2 | 3 | 4 | 5 | 6 | 7 | 8 | 9 | 10 | 11 |
| 0 | — | — | — | — | — | — | — | — | — | — | — |
| 1 | 30 | — | 1 | 4 | 5 | 4 | 5 | 8 | 8 | 12 | 12 |
| 2 | 38 | 2 | 1.5 | 9.5 | 8 | 9 | 17 | 11 | 9 | 11 | 12.5 |
| 3 | 39.2 | 5.5 | 2.5 | 11.5 | 10 | 10.5 | 17 | 12.5 | 9.5 | 11 | 12.5 |
| 4 | 40.5 | 6.5 | 3.5 | 12 | 10.5 | 11.5 | 18 | 13 | 9.5 | 11.5 | 12.5 |
| 5 | 39.5 | 6.5 | 3.5 | 13.5 | 11 | 11.5 | 18 | 13.5 | 9.5 | 11.5 | 13 |
| 6 | 39.5 | 6.5 | 4 | 14 | 11 | 12.0 | 18 | 14 | 10 | 11.5 | 13 |
| 7 | 38.5 | 7 | 3.5 | 14.5 | 11.5 | 12.0 | 18.5 | 14.5 | 10 | 12 | 13 |
| 8 | 37.5 | 7 | 4 | 15 | 11.5 | 12.0 | 18.5 | 14 | 10 | 12 | 13.5 |
| 9 | 37.5 | 7 | 4 | 15 | 11.5 | 12.0 | 18.5 | 14.5 | 10 | 12 | 13.5 |
| 10 | 37.2 | 7 | 4 | 15.5 | 11.5 | 13.0 | 18.5 | 15 | 10.5 | 12 | 13.5 |
| 11 | 38 | 10 | 30 | 15.5 | 11.5 | 12.0 | 19 | 15 | 10.5 | 12 | 14 |
| 12 | 40 | 25 | 80 | 16 | 11.5 | 13.0 | 19.5 | 15 | 10.5 | 12 | 14 |
| 13 | 42 | 40 | >100 | 18 | 12 | 15.0 | 22 | 16.5 | 10.5 | 12 | 14 |
| 14 | 50 | 65 | >100 | 20.5 | 13 | 16.0 | 26 | 18 | 10 | 12 | 14 |
| 15 | >100 | 95 | >100 | 35 | 25 | 18.0 | 38 | 19.5 | 10 | 12 | 14.5 |
| $\Delta\mu$15-1 | >70 | 93 | >99 | 31 | 20 | 14 | 33 | 11.5 | 2 | 0 | 2.5 |

A small $\Delta\mu$15-1 is indicative of a relatively homogeneous mixture and thus indicates an effective suspending agent. As may be seen, the compounds of the present invention are more efficacious than any of the other compounds tabulated.

What is claimed is:

1. A fuel slurry comprising:
(a) 10 to 60 weight percent coal particles, at least 80 percent of said particles being smaller than 200 mesh;
(b) 39 to 89 weight percent liquid hydrocarbon fuel;
(c) 0.5 to 3.0 weight percent water; and
(d) 0.1 to 1.0 weight percent of a stabilizer, said stabilizer corresponding to the general formula:

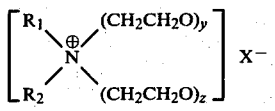

wherein $R_1$ and $R_2$ are each straight or branched-chain aliphatic groups having from 8 to 22 carbon atoms, wherein y and z are integers having a value of 1 or greater, the sum of y and z being between 2 and 15, and wherein X is an anion selected from the group consisting of $CH_3COO^-$, $Cl^-$, $BO_3^-$, and $(CH_3)_2SO_4^-$, and wherein said slurry remains in a substantially homogeneous state when left standing without agitation for at least twenty-four hours.

2. The fuel slurry composition as set forth in claim 1, wherein the sum of x and y in said stabilizer is 8.

3. The fuel slurry composition as set forth in claim 1, wherein each of said R groups are straight chain aliphatic groups.

4. The fuel slurry composition as set forth in claim 2, wherein each of said R groups are straight chain aliphatic groups.

5. The fuel slurry composition as set forth in claim 4, wherein said R groups are each $C_{12}H_{25}-$.

6. The fuel slurry composition as set forth in claim 4, wherein said R groups are each $C_{18}H_{35}-$.

7. The fuel slurry composition as set forth in claim 1, wherein said coal particles comprise comminuted Pittsburgh Seam Coal.

8. The fuel slurry composition as set forth in claim 7, wherein said anion is $BO_3-$.

9. The fuel slurry composition as set forth in claim 7, wherein said $R_1$ and $R_2$ groups are each $C_{12}H_{25}-$.

10. The fuel slurry composition as set forth in claim 1, wherein said hydrocarbon fuel is a fuel oil.

11. A fuel slurry composition comprising:
(a) 10 to 60 weight percent Pittsburgh Seam Coal particles, 80 percent of said particles being smaller than 200 mesh;
(b) 39 to 89 weight percent of a No. 6 grade fuel oil;
(c) 0.5 to 3.0 weight percent deionized water; and
(d) 0.1 to 1.0 weight percent of the stabilizer:

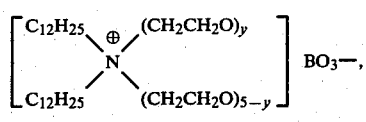

wherein y is an integer between 1 and 4, and wherein said slurry remains in a substantially homogeneous state when left standing without agitation for at least twenty-four hours.

* * * * *